US010363491B2

(12) United States Patent
Ferreyra et al.

(10) Patent No.: US 10,363,491 B2
(45) Date of Patent: Jul. 30, 2019

(54) MODULAR TOY VEHICLE WITH DRIVE MECHANISM

(71) Applicant: Mattel, Inc., El Segundo, CA (US)

(72) Inventors: Gustavo Ricardo Ferreyra, Los Angeles, CA (US); Michael Finizza, Los Angeles, CA (US); Julian R. Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/707,089

(22) Filed: Sep. 18, 2017

(65) Prior Publication Data

US 2018/0078867 A1 Mar. 22, 2018

Related U.S. Application Data

(60) Provisional application No. 62/396,777, filed on Sep. 19, 2016.

(51) Int. Cl.

| | |
|---|---|
| ***A63H 17/00*** | (2006.01) |
| ***A63H 29/18*** | (2006.01) |
| ***A63H 17/26*** | (2006.01) |
| ***A63H 17/38*** | (2006.01) |
| ***A63H 29/24*** | (2006.01) |

(52) U.S. Cl.

CPC ..... *A63H 17/002* (2013.01); *A63H 17/262* (2013.01); *A63H 17/38* (2013.01); *A63H 29/18* (2013.01); *A63H 29/24* (2013.01)

(58) Field of Classification Search

CPC .... A63H 17/002; A63H 29/18; A63H 17/262; A63H 17/38; A63H 29/24

USPC ..... 446/91, 94, 95, 96

See application file for complete search history.

(56) References Cited

U.S. PATENT DOCUMENTS

| | | | |
|---|---|---|---|
| 108,224 | A | 10/1870 | Wickham |
| 200,714 | A | 2/1878 | Groth |
| 202,651 | A | 4/1878 | Hoard |
| 782,076 | A | 2/1905 | Soule |
| 1,203,438 | A | 10/1916 | Webster |

(Continued)

FOREIGN PATENT DOCUMENTS

| | | | |
|---|---|---|---|
| DE | 1809644 | A1 | 6/1970 |
| DE | 3035294 | A1 | 3/1982 |

(Continued)

*Primary Examiner* — Vishu K Mendiratta

(74) *Attorney, Agent, or Firm* — Edell, Shapiro & Finnan, LLC

(57) ABSTRACT

An improved toy vehicle is disclosed herein. The toy vehicle includes a plurality of different modules that may be removably coupled to one another to provide a variety of different toy vehicles. The modules include at least a steering module, a gearbox module, and a main body module. The main body module may house any number of elastic members configured to drive a drive axle disposed within the gearbox module. The size and construction of the main body module chosen to be used may dictate how fast and how far the modular toy vehicle is capable of traveling across a support surface. The gearbox module may further include a crank that enables the elastic members to be wound and an actuator that actuates the wound elastic members to drive the toy vehicle. Finally, the steering module may be configured to direct the modular toy vehicle in a desired direction.

20 Claims, 12 Drawing Sheets

(56) References Cited

U.S. PATENT DOCUMENTS

| | | | | | |
|---|---|---|---|---|---|
| 1,311,415 | A | | 7/1919 | Parrish | |
| 1,399,667 | A | | 12/1921 | Sladek | |
| 1,427,790 | A | | 9/1922 | Earley | |
| 1,699,360 | A | | 1/1929 | Husted | |
| 1,936,072 | A | | 11/1933 | Roderick | |
| 2,100,590 | A | | 11/1937 | Grady | |
| 2,113,750 | A | | 4/1938 | Travis | |
| 2,200,686 | A | | 5/1940 | Beckman | |
| 2,558,112 | A | | 6/1951 | Travis | |
| 2,568,557 | A | * | 9/1951 | Newbery | A63H 33/108 446/122 |
| 2,677,915 | A | | 5/1954 | Fasano | |
| 2,749,660 | A | * | 6/1956 | Zimentstark | A63H 29/18 446/459 |
| 2,881,864 | A | | 4/1959 | Rubenstein | |
| 2,941,623 | A | | 6/1960 | Tarrson | |
| 3,068,614 | A | | 12/1962 | Fasano | |
| 3,174,254 | A | | 3/1965 | Keck | |
| 3,221,446 | A | | 12/1965 | Keck | |
| 3,474,566 | A | | 10/1969 | Cagan | |
| 3,535,947 | A | | 10/1970 | Kupperman et al. | |
| 3,601,924 | A | | 8/1971 | Lechner et al. | |
| 3,602,337 | A | | 8/1971 | Cain | |
| 3,611,631 | A | | 10/1971 | Folson | |
| 3,645,039 | A | | 2/1972 | Bross | |
| 3,656,586 | A | | 4/1972 | Robson | |
| 3,720,016 | A | | 3/1973 | Kupperman et al. | |
| 3,721,317 | A | | 3/1973 | Gay et al. | |
| 3,769,746 | A | | 11/1973 | Prodger et al. | |
| 3,772,822 | A | | 11/1973 | Kupperman et al. | |
| 3,878,642 | A | * | 4/1975 | Lemelson | A63H 29/18 446/176 |
| 4,121,376 | A | * | 10/1978 | Lemelson | A63H 29/18 446/176 |
| 4,193,597 | A | * | 3/1980 | Ogawa | A63H 17/002 273/405 |
| 4,276,716 | A | * | 7/1981 | Mabuchi | A63H 29/18 185/45 |
| 4,406,084 | A | | 9/1983 | D'Andrade | |
| 4,416,083 | A | | 11/1983 | Kubiatowicz | |
| 4,629,438 | A | | 12/1986 | McAneny | |
| 4,940,442 | A | * | 7/1990 | Matsuda | A63H 17/264 213/75 TC |
| 5,562,522 | A | * | 10/1996 | Richno | A63H 18/00 446/444 |
| 5,762,533 | A | * | 6/1998 | Tilbor | A63H 17/262 280/43.23 |
| 6,638,132 | B1 | | 10/2003 | Li | |
| 8,132,651 | B2 | | 3/2012 | Sink et al. | |
| 8,696,402 | B2 | | 4/2014 | Robins et al. | |
| 2009/0137184 | A1 | * | 5/2009 | Schreff | A63H 33/088 446/120 |

FOREIGN PATENT DOCUMENTS

| | | | | |
|---|---|---|---|---|
| GB | 150865 | A | | 9/1920 |
| GB | 171500 | A | | 11/1921 |
| GB | 765142 | A | | 1/1957 |
| WO | WO03/059723 | A1 | * | 7/2003 |

* cited by examiner

FIG.13
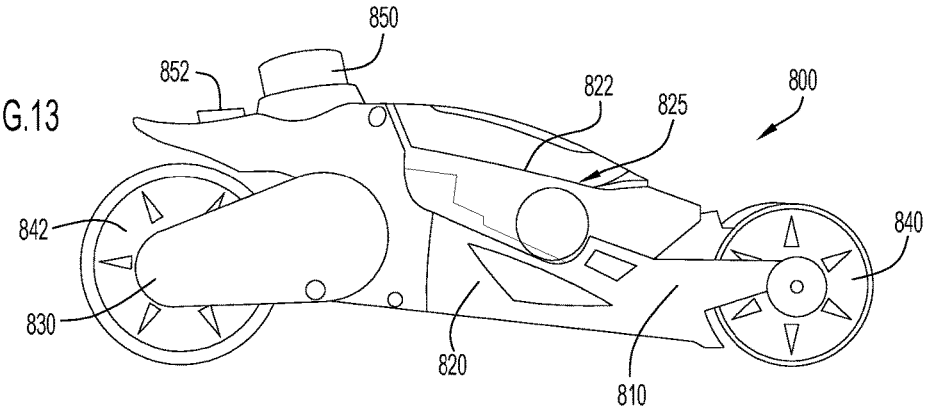
FIG.14
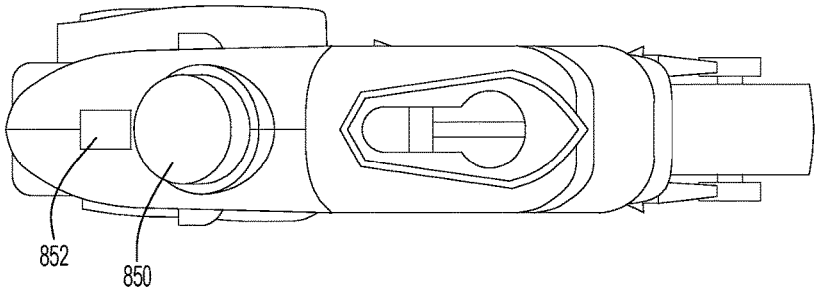
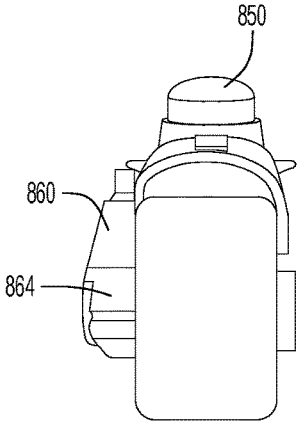
FIG.15
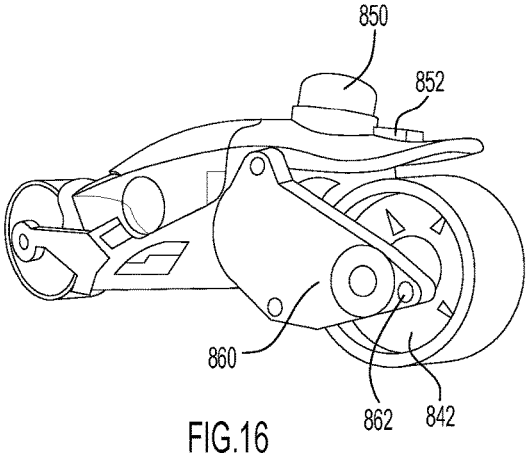
FIG.16

MODULAR TOY VEHICLE WITH DRIVE MECHANISM

CROSS-REFERENCE TO RELATED APPLICATIONS

This application claims priority under 35 U.S.C. 119(e) to U.S. Provisional Patent Application Ser. No. 62/396,777, entitled "Modular Toy Vehicle with Drive Mechanism," filed Sep. 19, 2016, the disclosure of which is incorporated herein by reference in its entirety for all purposes.

FIELD OF THE INVENTION

The present invention relates to a toy vehicle. More specifically, the invention relates to a modular toy vehicle, where the modular toy vehicle contains a drive mechanism that propels the modular toy vehicle across a support surface. In addition, the propulsion speed of the modular toy vehicle and propulsion distance of the modular toy vehicle are dependent upon the type and number of modular segments that are connected to one another to form the modular toy vehicle.

BACKGROUND OF THE INVENTION

Toy vehicles provide entertainment to children. Current toy vehicles may be utilized on tracks, playsets, or may be remotely controlled by children. While current toy vehicles are very popular with children, current toy vehicles have limited play patterns. For example, toy vehicles are limited to the appearance and features with which they are provided. In addition, if the toy vehicle includes a drive or other type of propelling mechanism, these mechanisms are often not customizable. Thus, convention toy vehicles contain a limited number of play patterns and provide little development of a child's cognitive abilities, especially a child's problem solving abilities.

It is desirable to provide a toy vehicle that is entertaining to children while also being educational. It is also desirable to provide a modular toy vehicle, where the toy vehicle may be selectively constructed by a child using various different vehicle modules. A child may combine a variety of different modules to determine both the appearance of the modular toy vehicle and the performance characteristics of the modular toy vehicle. Thus, it would be desirable to provide a modular toy vehicle that has a large amount of play patterns, and thus, provides a high replay or re-use value for children. It would also be desirable to provide a toy vehicle that is interactive, and reconfigurable in multiple different configurations.

SUMMARY OF THE INVENTION

An improved toy vehicle is disclosed herein. The toy vehicle includes a several modules that may be removably coupled to one another to provide a variety of different configurations of toy vehicles. The different modules used to construct a modular toy vehicle may include at least a front or steering module, a rear or gearbox module, and a main body or drive module. The main body module may include a chamber or interior that can house or contain any number of elastic members that, when wound, including around one another, within the interior of the main body module, are configured to drive a drive axle disposed within the gearbox module. The elastic members are fixed at one end and the opposite end thereof is rotated to twist the elastic members to store energy therein. The size and/or construction of the main body module chosen for the construction of the modular toy vehicle may dictate how fast and how far the modular toy vehicle is capable of traveling across a support surface. The gearbox module may further include a crank that enables the elastic members to be wound and an actuator that actuates the wound elastic members, allowing their stored energy to be released, to drive the toy vehicle. Finally, the steering module may be configured to direct the modular toy vehicle in a desired direction.

BRIEF DESCRIPTION OF THE DRAWINGS

FIG. 13 illustrates a side view of a toy vehicle in accordance with another embodiment of the present invention.

FIG. 14 illustrates a top view of the toy vehicle in FIG. 13.

FIG. 15 illustrates a rear view of the toy vehicle in FIG. 13.

FIG. 16 illustrates a rear perspective view of the toy vehicle in FIG. 13.

Like reference numerals have been used to identify like elements throughout this disclosure.

DETAILED DESCRIPTION OF THE INVENTION

The present invention disclosed herein is a modular toy vehicle having multiple modules or segments. The modular toy vehicle may include at least one main body module, a steering module, and a gearbox module. The main body module may contain an interior cavity configured to house sets of connectors or hooks, where elastic members may be stretched from one set of connectors to another set of connectors. One set of connectors may be configured to rotate within the interior of the main body module, while the other set of connectors may remain fixed. The gearbox module may include a crank that, when rotated, causes one of the sets of connectors to rotate, which results in the elastic members being wound, including around each other. The gearbox module may further include an actuator that, when depressed, may release the wound elastic members to allow them to unwind. In addition, the gearbox module also includes a drive axle that is driven by the unwinding of the elastic members. A set of wheels may be coupled to the drive axle so that when the drive axle rotates, the wheels are forced to rotate. A set of wheels may also be coupled to the steering module. The steering module may also include a steering mechanism/steering arm that, when set by a user, changes the direction of the wheels coupled to the steering module to cause the modular toy vehicle to travel in a desired direction.

Figure 1:
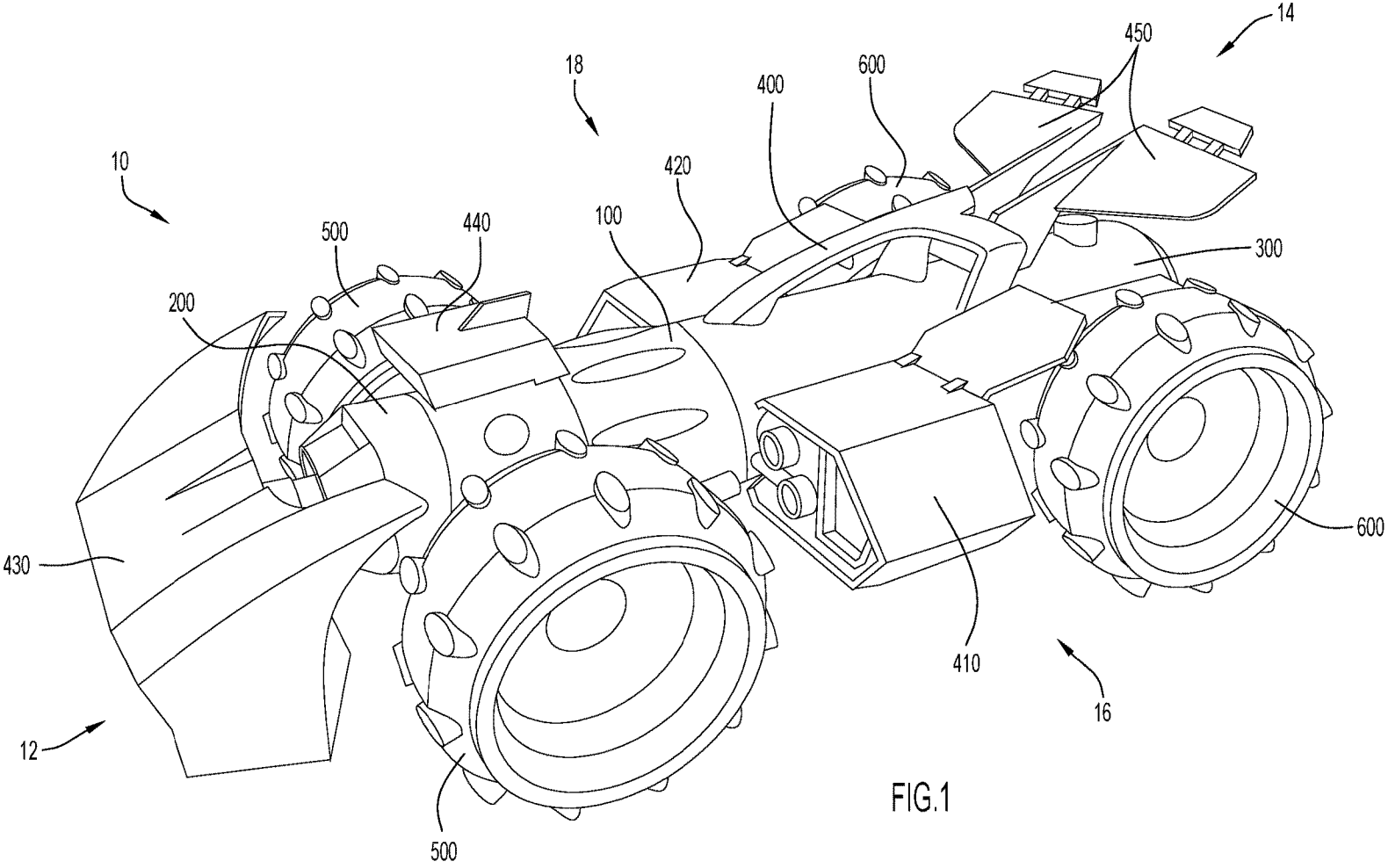
FIG. 1 illustrates a front perspective view of an embodiment of a modular toy vehicle according to the present invention.
Figure 2:
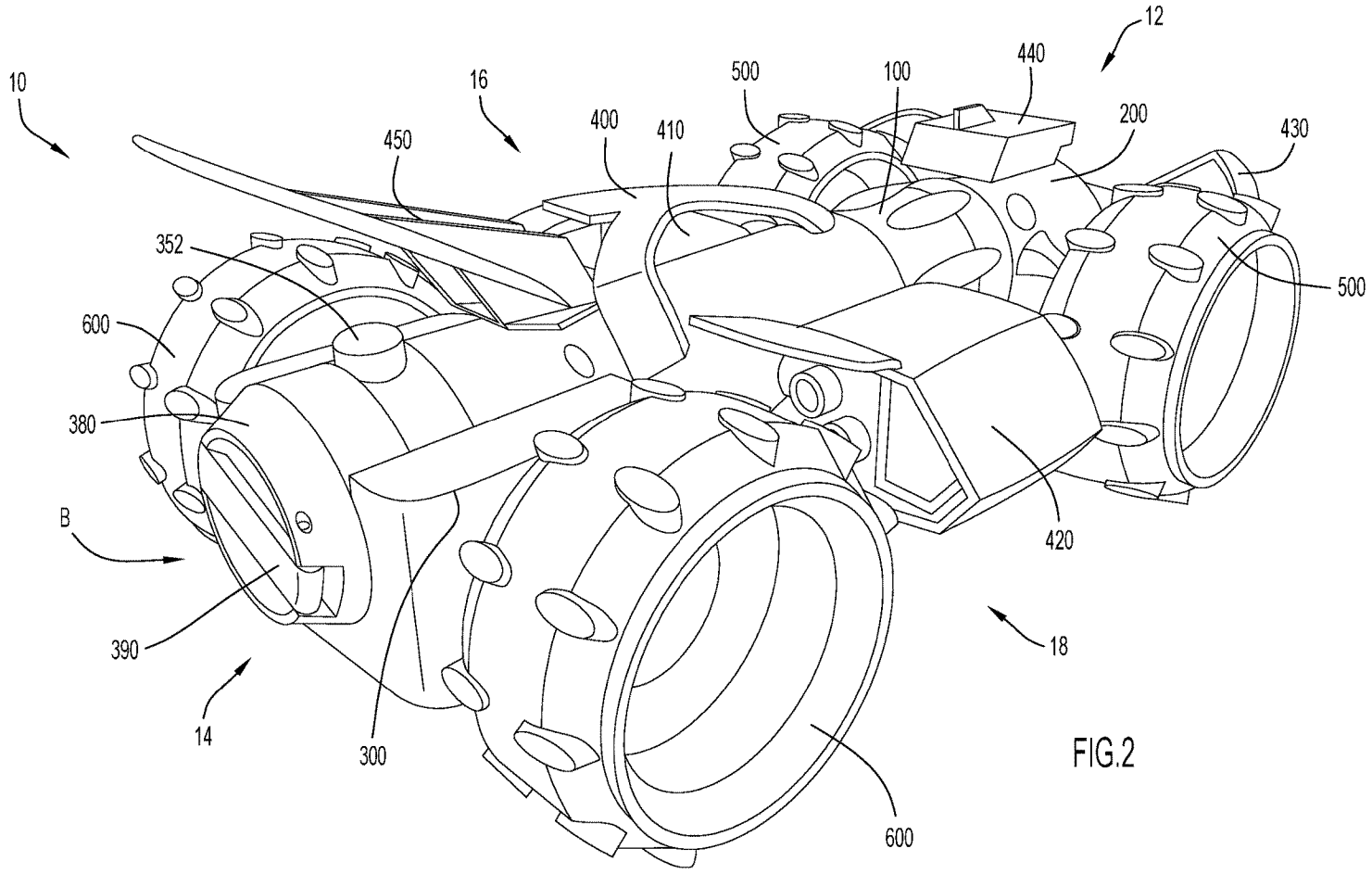
FIG. 2 illustrates a rear perspective view of the embodiment of the modular toy vehicle illustrated in FIG. 1.

As illustrated in FIGS. 1 and 2 the modular toy vehicle 10 contains at least a main body or drive module 100, a front or steering module 200, and a rear, gearbox, or drive module 300. The modular toy vehicle 10 includes a front end 12, a rear end 14 opposite the front end 12, a first side 16, and a second side 18 opposite the first side 16. As illustrated, the steering module 200 is coupled to the main body module 100 proximate to the front end 12 of the modular toy vehicle 10. Conversely, the gearbox module 300 is coupled to the main body module 100 proximate to the rear end 14 of the modular toy vehicle 10. Furthermore, a set of front wheels 500 may be coupled to the steering module 200. Similarly, a set of rear wheels 600 may be coupled to the gearbox module 300. In some embodiments, the rear wheels 600 may be larger in diameter than the front wheels 500. In addition, the number of front wheels 500 and rear wheels 600 may vary between embodiments. As also illustrated in FIGS. 1 and 2, the modular toy vehicle 10 includes a series of accessories 400-450, which will be explained in further detail below.

Figure 3:
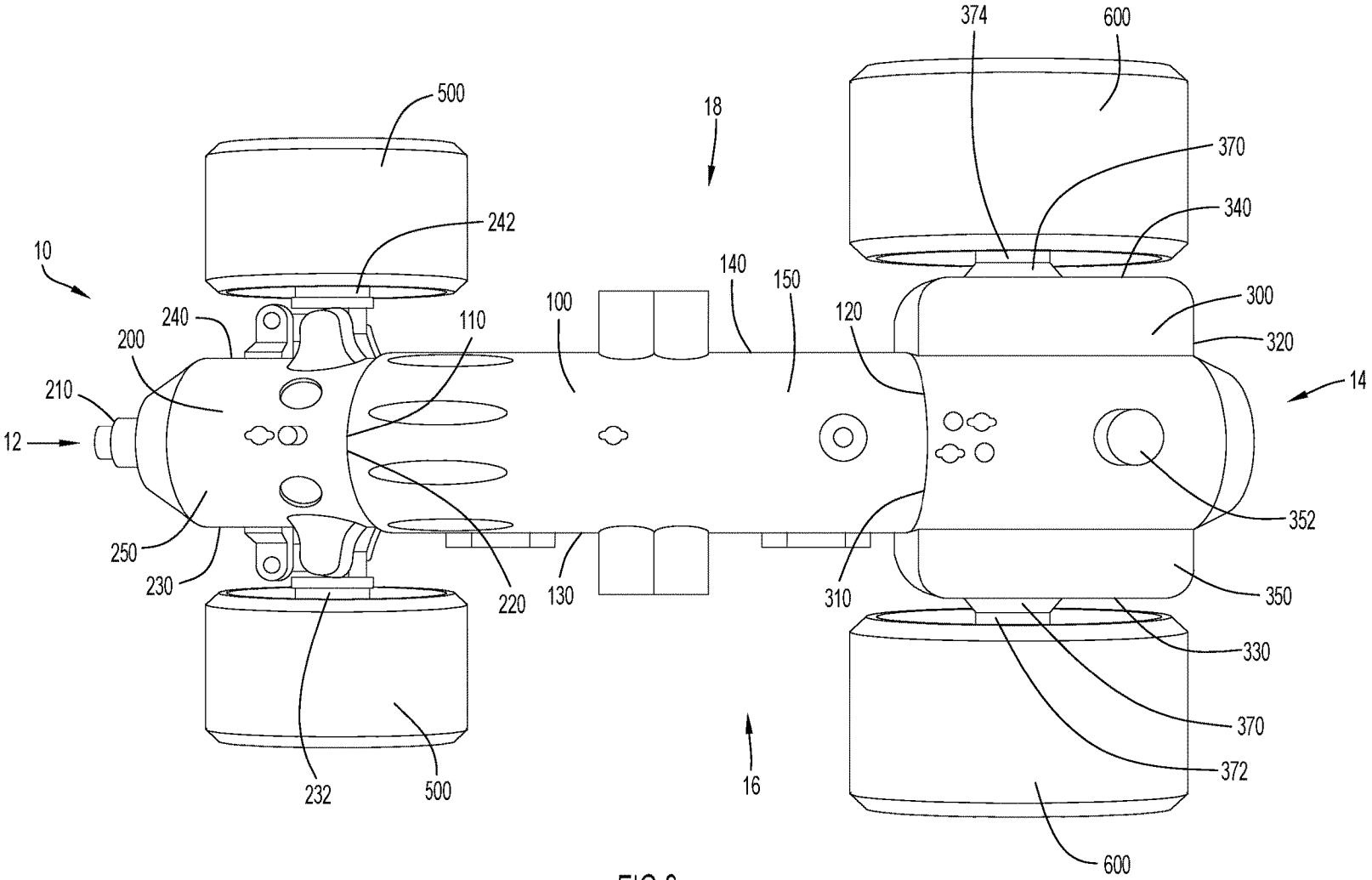
FIG. 3 illustrates a top view of the embodiment of the modular toy vehicle illustrated in FIG. 1.
Figure 4:
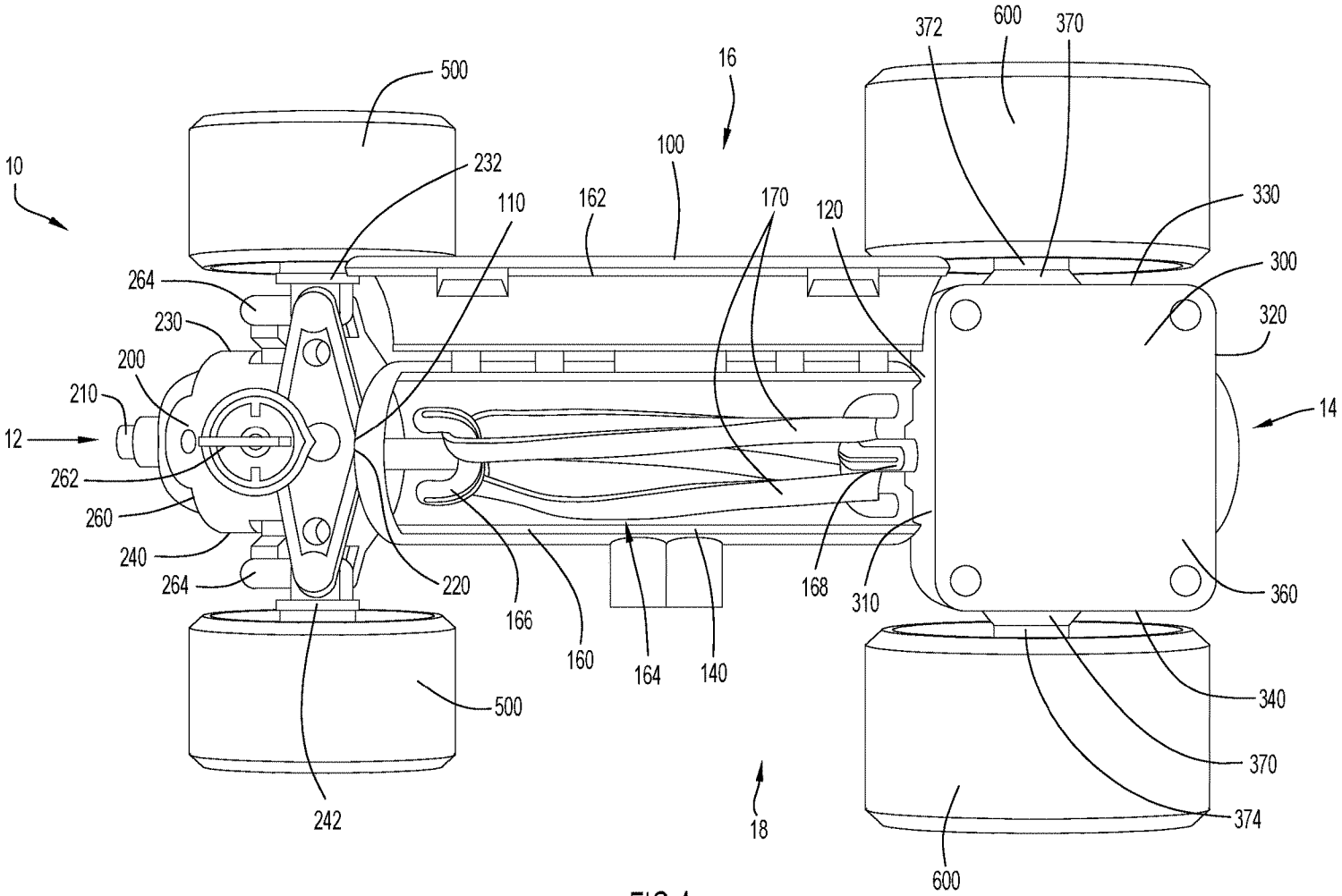
FIG. 4 illustrates a bottom view of the modular toy vehicle illustrated in FIG. 1.

Turning to FIGS. 3 and 4, illustrated are top and bottom views of the modular toy vehicle 10 without any accessories. As illustrated, the main body module 100 and includes a first/front end 110, a second/rear end 120 opposite the first end 110, a first side 130, and a second side 140 opposite of the first side 130. The main body module 100 also includes a top side 150 (illustrated in FIG. 3) and a bottom side 160 (illustrated in FIG. 4). While illustrated as being substantially cylindrical, the main body module 100 may be of any other desirable shape. The main body module 100 defines an internal chamber or receptacle 164.

As illustrated, main body module 100 includes a door 162 that is hingedly coupled to the bottom side 160 of the main body module 100. The door 162 is illustrated in an open position in FIG. 4. When in the open position, the door 162 provides access to the interior or receptacle 164 of the main body module 100. Disposed within the interior 164 is a first set of connectors 166 and a second set of connectors 168. As illustrated in FIG. 4, the first and second sets of connectors 166, 168 are hooks. The first set of connectors 166 are disposed within the main body module 100 proximate to the first end 110 of the main body module 100. The second set of connectors 168 are disposed within the main body module 100 proximate to the second end 120 of the main body module 100. The first set of connectors 166 may be stationary, while the second set of connectors 168 may be configured to rotate about a longitudinal or lengthwise axis of the main body module 100. Coupled to the first and second sets of connectors 166, 168 are one or more elastic/resilient members 170 (e.g., rubber bands). While only two elastic members 170 are disposed within the interior 164 of the main body module 100 in FIG. 4, any number of elastic members 170 may be disposed within the interior of the main body module 100.

Also illustrated in FIGS. 3 and 4 is the front or steering module 200. In one embodiment, the front module 200 may also be substantially cylindrical, but in different embodiments, it may have a different shape or configuration. As illustrated, the steering module 200 includes a first/front end 210, a second/rear end 220 opposite the first end 210, a first side 230, and a second side 240 opposite the first side 230. Similar to the main body module 100, the steering module 200 includes a top side 250 (illustrated in FIG. 3) and a bottom side 260 (illustrated in FIG. 4). The steering module 200 is removably coupled to the main body module 100. More specifically, the second end 220 of the steering module 200 is removably coupled to the first end 110 of the main body module 100.

Furthermore, a first axle or axle portion 232 extends from the first side 230 of the steering module 200, while, similarly, a second axle or axle portion 242 extends from the second side 240 of the steering module 200. In one embodiment, the first axle 232 may be pivotably coupled to the first side 230 of the steering module 200, and the second axle 242 may be pivotably coupled to the second side 240 of the steering module 200. The first and second axles or axle portions 232, 242 may each be configured to pivot about substantially vertical axes with respect to the steering module 200. In other words, the first axle 232 may be configured to pivot about a first axis that is substantially perpendicular to the longitudinal or lengthwise axis of the steering module 200, while the second axle 242 may be configured to pivot about a second axis that is parallel to the first axis and is also substantially perpendicular to the longitudinal or lengthwise axis of the steering module 200.

In some embodiments, the steering module 200 includes a single axle that extends entirely through the steering module 200 and from each of the sides 230, 240 of the steering module 200. Rotatably and removably coupled to the first and second axles 232, 242 are the front wheels 500. The front wheels 500 are configured to rotate about the axles 232, 242, which is substantially horizontal or transverse to the steering module 200. In addition, the front wheels 500 are configured to pivot with their respective axles 232, 242 when their respective axles 232, 242 are pivoted about their respective vertical axes to steer the vehicle as described below.

As further illustrated in FIG. 4, in one embodiment, the bottom side 260 of the steering module 200 includes a dial 262. In addition, a steering arm 264 extends outwardly from both the first and second sides 230, 240 at a location forward of the first and second axles 232, 242. The steering arm 264 may be operatively coupled to the dial 262 internal to the steering module 200, such that the dial 262 and the steering arm 264 form a rack and pinion or other type of linear actuator mechanism. Furthermore, the steering arm 264 may also be operatively coupled to the first and second axles 232, 242. Thus, rotation of the dial 262 causes the steering arm 264 to move relative to the dial 262, thereby translating the rotational motion of the dial 262 into linear motion of the steering arm 264. Because of the connection of the steering arm 264 to the first and second axles 232, 242, the linear motion of the steering arm 264 imparts pivotal movement of the first and second axles 232, 242 to steer the vehicle.

FIGS. 2-4 also illustrate the gearbox module 300. As illustrated, the gearbox module 300 may be substantially rectangular. Other embodiments of the gearbox module 300, however, may be of any other suitable shape. The gearbox module 300 includes a first/front end 310, a second/rear end 320 opposite the first end 310, a first side 330, and a second side 340 opposite of the first side 330. Similar to both the main body module 100 and the steering module 200, the gearbox module 300 includes a top side 350 (illustrated in FIG. 3) and a bottom side 360 (illustrated in FIG. 4). The gearbox module 300 is removably coupled to the main body module 100. More specifically, the first end 310 of the gearbox module 200 is removably coupled to the second end 120 of the main body module 100.

Furthermore, a drive axle 370 extends through the gearbox module 300, where a first drive axle end 372 extends from the first side 330 of the gearbox module 300, and a second drive axle end 374 extends from the second side 340 of the gearbox module 300. The drive axle 370 may be configured to rotate about a substantially horizontal or transverse axis with respect to the gearbox module 300. As further illustrated, a rear wheel 600 is removably coupled to the first drive axle end 372 and another rear wheel 600 is removable coupled to the second drive axle end 374. The drive axle 370 may be operatively connected, for example via a gear train, to the second set of connectors 168 such that rotation of the second set of connectors 168 in a certain direction causes the drive axle 370 to also rotate.

As further illustrated in FIG. 3, the top side 350 of the gearbox module 300 includes an actuator 352, which will be explained in further detail below. The actuator 352 is configured to release the drive axle 370 to rotate with respect to the gearbox module 300.

Figure 5:
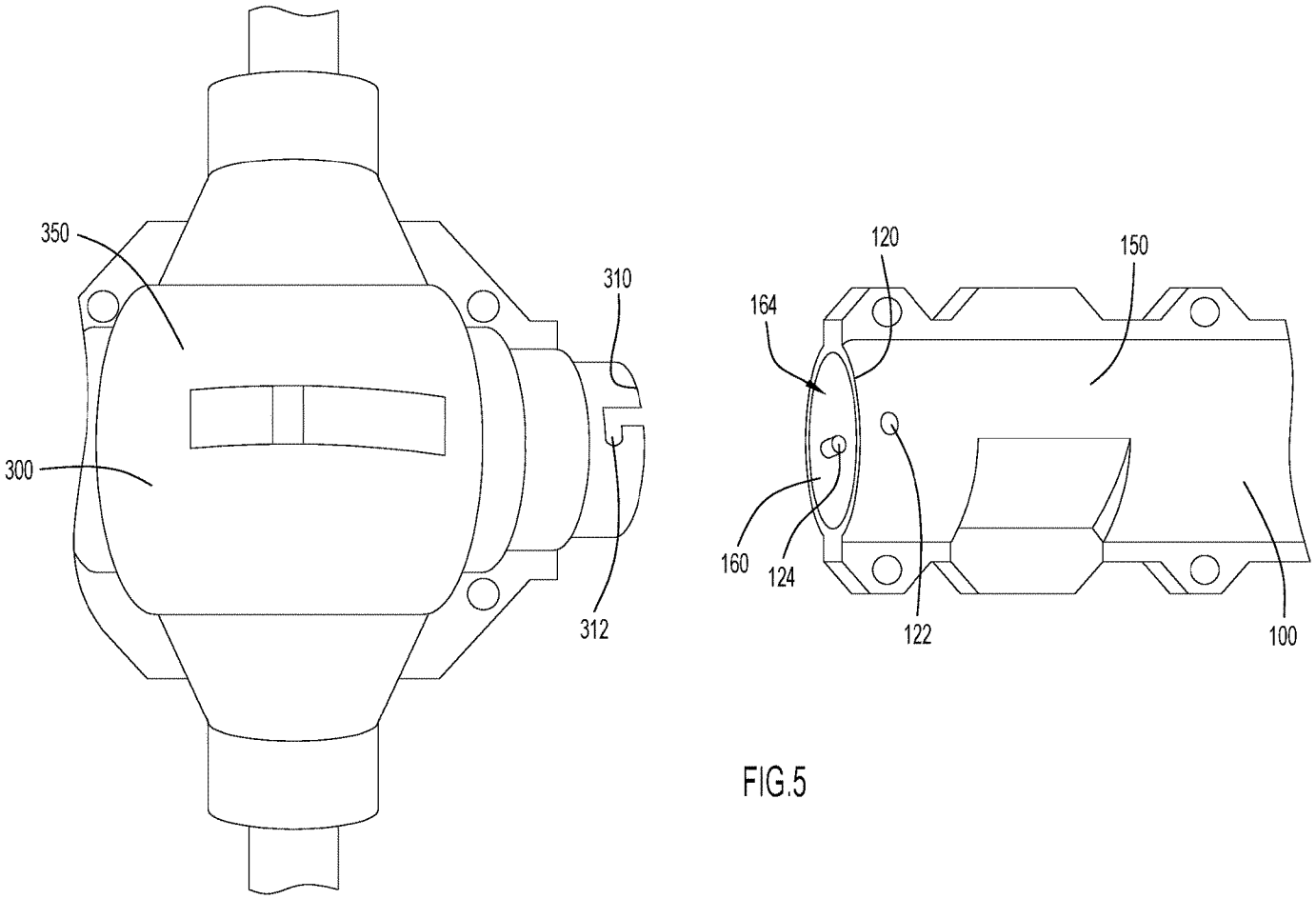
FIG. 5 illustrates a perspective view of two modular sections or segments of the embodiment toy vehicle illustrated in FIG. 1 being connected to one another.

The connection of gearbox module 300 to the main body module 100 is illustrated in FIG. 5. While FIG. 5 only illustrates the main body module 100 and the gearbox module 300, the connection of the steering module 200 to the main body module 100 may be substantially similar to that illustrated in FIG. 5. As illustrated, the second end 120 of the main body module 100 may include a first protuberance 122 and a second protuberance 124. The first protuberance 122 may extend into the interior 164 of the main body module 100 from the top side 150 of the main body module 100. Conversely, the second protuberance 124 may extend into the interior 164 of the main body module 100 from the bottom side 160 of the main body module 100. Thus, the first and second protuberances 122, 124 extend toward one another. In other embodiments, the first and second protuberances 122, 124 may be disposed on the first and second sides 130, 140 of the main body module 100 rather than the top and bottom sides 150, 160. While not illustrated, the first end 110 of the main body module 100 may be substantially similar to the second end 120 of the main body module 100, where the first end 110 may also include first and second protuberances.

As further illustrated in FIG. 5, the first end 310 of the gearbox module 300 includes a first slot 312 proximate to the top side 350 of the first end 310. The first end 310 may also include a second slot 314 (not illustrated) proximate to the bottom side 360 of the first end 310 of the gearbox module 300. The first and second slots 312, 314 may be substantially L-shaped, but the second slot 314 may be a mirror image of the first slot 312. The first and second slots 312, 314 may be sized to receive the first and second protuberances 122, 124, respectively. As previously mentioned, while not illustrated, the second end 220 of the steering module 200 may be substantially similar to the first end 310 of the gearbox module 300. Thus, the second end 220 of the steering module 200 may include two slots that are sized to receive protuberances disposed on the first end 110 of the main body module 100. In addition, the slots on the second end 220 of the steering module 200 may be L-shaped like that of the slots 312, 314 of the first end 310 of the gearbox module 300.

To connect the gearbox module 300 to the second end 120 of the main body module 100, the first end 310 of the gearbox module 300 may be partially inserted into the second end 120 of the main body module 100 such that the first and second slots 312, 314 receive the first and second protuberances 122, 124, respectively. Then, the gearbox module 300 or the main body module 100 is rotated so that the protuberances 122, 124 are positioned near the closed ends of the slots 312, 314 so that the gearbox module 300 is secured to the main body module 100. Thus, once rotated, the gearbox module 300 and the main body module 100 cannot be separated by pulling each linearly away from one another. The second end 220 of the steering module 200 may connect to the first end 110 of the main body module 100 in a similar manner to how the gearbox module 300 connects to the second end 120 of the main body module 100.

In other embodiments, the gearbox module 300 and the steering module 200 may be removably coupled to the ends 110, 120 of the main body module 100 via a friction fit. In yet another embodiment, the gearbox module 300 and the steering module 200 may be removably coupled to the ends 110, 120 of the main body module 100 by a snap fit. In even other embodiments, the gearbox module 300 and the steering module 200 may be removably coupled to the ends 110, 120 of the main body module 100 by connectors or fasteners, such as magnets, buttons, ties, screws, etc.

Figure 6:
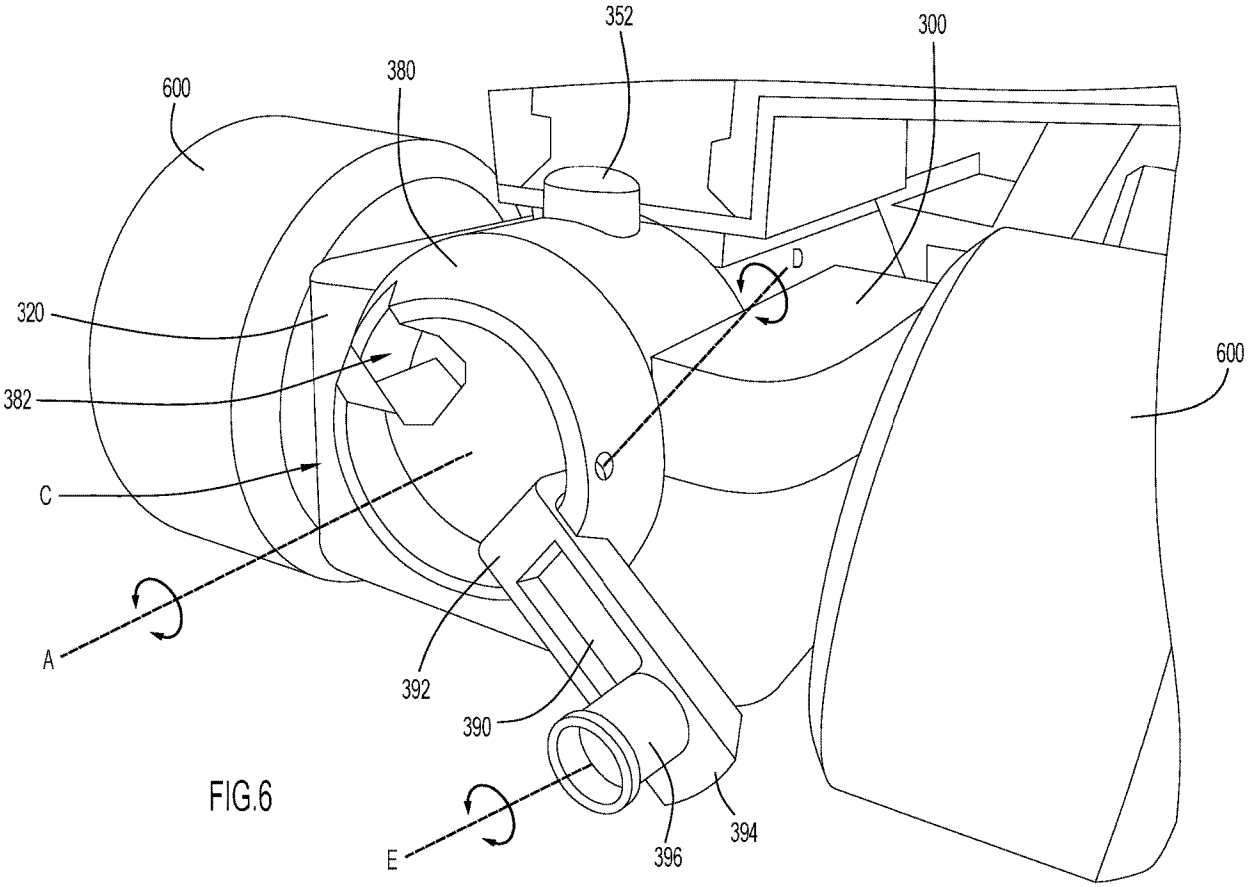
FIG. 6 illustrates a rear view of the embodiment of the modular toy vehicle illustrated in FIG. 2, wherein the handle of the crank is in the deployed position.

As illustrated in FIG. 6, a crank or second actuator 380 is disposed on the second end 320 of the gearbox module 300. The crank 380 is disposed on the second end 320 of the gearbox module 300 between the top surface 350 and the bottom surface 360. The crank 380 is configured to rotate about axis A, which runs along the longitudinal or lengthwise direction of the modular toy vehicle 10. The crank 380 may be circular in shape, and along the edge of the crank 380 is an opening 382. Also disposed along the edge of the crank 380, opposite of the opening 382, is a pivotable handle 390. As illustrated, the pivotable handle 390 includes a proximal end 392 and a distal end 394. The proximal end 392 of the pivotable handle 390 is pivotably coupled to the edge of the crank 380. The handle 390 is configured to pivot between a stored position B (illustrated in FIG. 2) and a deployed position C (illustrated in FIG. 6). The pivotable handle 390 is configured to pivot between the stored position B and the deployed position C about an axis D that extends through the proximal end 392 of the pivotable handle 390. Axis D may be perpendicular to axis A, about which the crank 380 rotates. Disposed on the distal end 394 of the handle 390 is a knob 396. Knob 396 is configured to rotate about axis E, which extends through the distal end 394 of the handle 390. Axis E is perpendicular to axis D and parallel to axis A when the pivotable handle 390 is positioned in both the stored position B and the deployed position C.

While not illustrated, the crank 380, the actuator 352, the drive axle 370, and the second set of connectors 168 are operatively connected to one another within the gearbox module 300. To operate a constructed modular toy vehicle 10, a user repositions the handle 390 from the stored position B to the deployed position C. Once in the deployed position C, the user may grab the knob 396 and rotate the handle 390 about axis A in either the clockwise or counter-clockwise direction to force the crank 380 to rotate about axis A. As the crank 380 is rotated about axis A, the knob 396 spins about axis D. The rotation of the knob 396 about axis A forces the handle 390 and the crank 380 to also rotate about axis A.

Because the crank 380 is operatively coupled to the second set of connectors 168, the rotation of the crank 380 causes the second set of connectors 168 to rotate within the interior 164 of the main body module 100. Thus, rotation of the crank 380 causes the elastic members 170 disposed within the main body module 100 to be wound or coiled, including around one another to become intertwined. Once rotated in a first direction, the second set of connectors 168 may be prevented, via a locking mechanism, from rotating in a second direction opposite of the first direction. Thus, the elastic members 170 may remain stored in the wound or coiled configuration until released. The winding or coiling of the elastic members 170 stretches the elastic members 170, which causes the elastic members 170 to store potential energy.

After rotating the crank 380 a desired amount, the user may reposition the handle 390 back into the stored position C. Then the user may depress the actuator 352 disposed on the top side 350 of the gearbox module 300 to release the lock mechanism which allows the second set of connectors 168 to freely rotate. When the actuator 352 is depressed and the elastic members 170 have already been wound, the potential energy stored within the wound/coiled elastic members 170 causes the second set of connectors 168 to rotate in the second direction until the elastic members 170 are unwound. As previously explained, this second rotation of the second set of connectors 168 may be opposite, or in reverse of, the first direction in which the second set of connectors 168 were rotated to wind or coil the elastic members 170. The unwinding of the elastic members 170, and rotation of the second set of connectors 168 in the second direction drives the drive axle 370 to rotate. The rotation of drive axle 370 causes the rear wheels 600 to rotate, which drives the modular toy vehicle 10 to travel across a support surface.

In yet another, alternate, embodiment, depression of the actuator 352 locks, or prevents, the drive axle 370 from rotation. Thus, prior to depression of the actuator 352, the drive axle 370 is free to rotate. In this embodiment, in order to operate the modular toy vehicle 10, a user repositions the handle 390 from the stored position B to the deployed position C. Once in the deployed position C, the user may depress the actuator 352, and then rotate the knob 396, and subsequently the crank 380, about axis A in either the clockwise or counter-clockwise direction. As previously explained, rotation of the crank 380 causes the second set of connectors 168 to rotate within the interior 164 of the main body module 100, which causes the elastic members 170 disposed within the main body module 100 to be wound or coiled around one another and become intertwined.

After rotating the crank 380 a desired amount, the user may reposition the handle 390 back into the stored position C while still keeping the actuator 352 depressed. Once the user is ready for the modular toy vehicle 10 to travel across a support surface, the user may release the actuator 352, which simultaneously releases the second set of connectors 168 to freely rotate. Thus, when the actuator 352 is released, the potential energy stored within the wound/coiled elastic members 170 causes the second set of connectors 168 to rotate until the elastic members 170 are unwound. As previously explained, this drives the drive axle 370 to rotate, which causing the modular toy vehicle 10 to travel across a support surface.

Returning to FIGS. 1 and 2, the modular toy vehicle 10 may include a series of accessories that accent the styling of the modular toy vehicle 10. The modular toy vehicle 10 illustrated in FIGS. 1 and 2 includes a first accessory 400 disposed on the top side 150 of the main body module 100, a second accessory 410 disposed on the first side 130 of the main body module 100, and a third accessory 420 disposed on the second side 140 of the main body module 100. Furthermore, a fourth accessory 430 may be disposed on the first end 210 of the steering module 200, while a fifth accessory 440 may be disposed on the top side 250 of the steering module 200. Finally, a sixth accessory 450 may be disposed on the top side 350 of the gearbox module 300. Each of the accessories 400-450 may be removably coupled to the main body module 100, steering module 200, and/or gearbox module 300. The accessories 400-450 may be used to provide different types of styling to the modular toy vehicle 10, giving the user the ability to selectively personalize the appearance of the modular toy vehicle 10.

Figure 7:
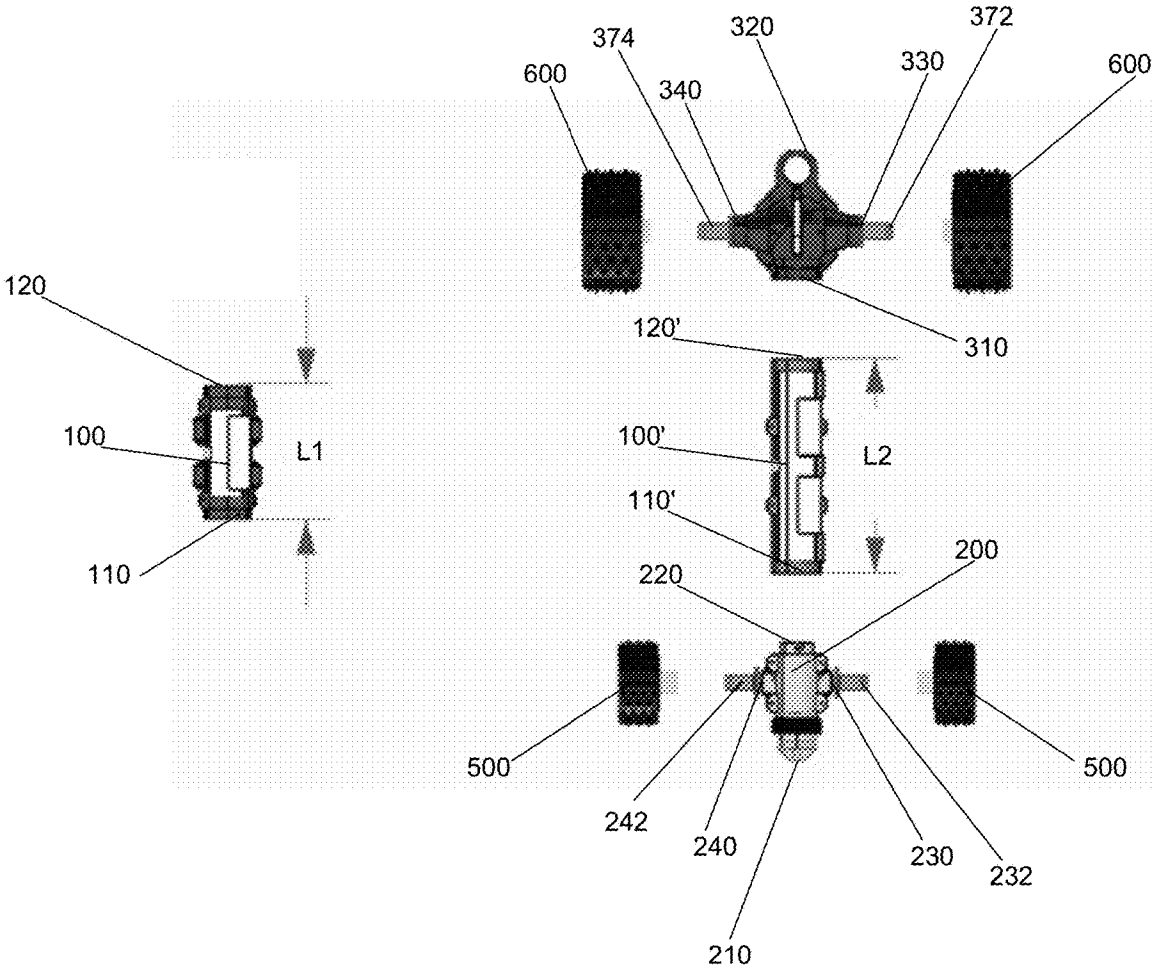
FIG. 7 illustrates multiple modules of a modular toy vehicle in accordance with an embodiment of the present invention.

Turning to FIG. 7, illustrated are the multiple modules of a modular toy vehicle 10. As previously explained, the modular toy vehicle 10 includes a main body module 100, a steering module 200, and a gearbox module 300. However, the modular toy vehicle 10 may contain different main body modules. Illustrated in FIG. 7 is a first main body module 100 and a second main body module 100'. The first and second main body modules 100, 100' may be substantially similar to one another, but the second main body module 100' may be longer in length than the first main body module 100. As illustrated, the first main body module 100 may be of a first length L1, which is the distance between the first end 110 and the second end 120 of the first main body module 100. The second main body module 100' may be of a second length L2, which is the distance between the first end 110' and the second end 120' of the second main body module 100'. The length L2 may be greater than the length L1, thus making the second main body module 100' longer than the first main body module 100.

When constructing the modular toy vehicle 100, the user may attach the steering module 200 and the gearbox module 300 to either of the first main body module 100 or the second main body module 100'. The longer length of the second main body module 100' enables a user to place longer elastic members 170 within the interior of the second main body module 100' than that of the first main body module 100. Longer elastic members 170 may be wound more than shorter elastic members 170. Thus, the longer elastic members 170 may allow a modular toy vehicle 10 equipped with the second main body module 100' to travel faster and/or farther across a support surface when compared to that of a modular toy vehicle 10 equipped with the first main body module 100.

Figure 8:
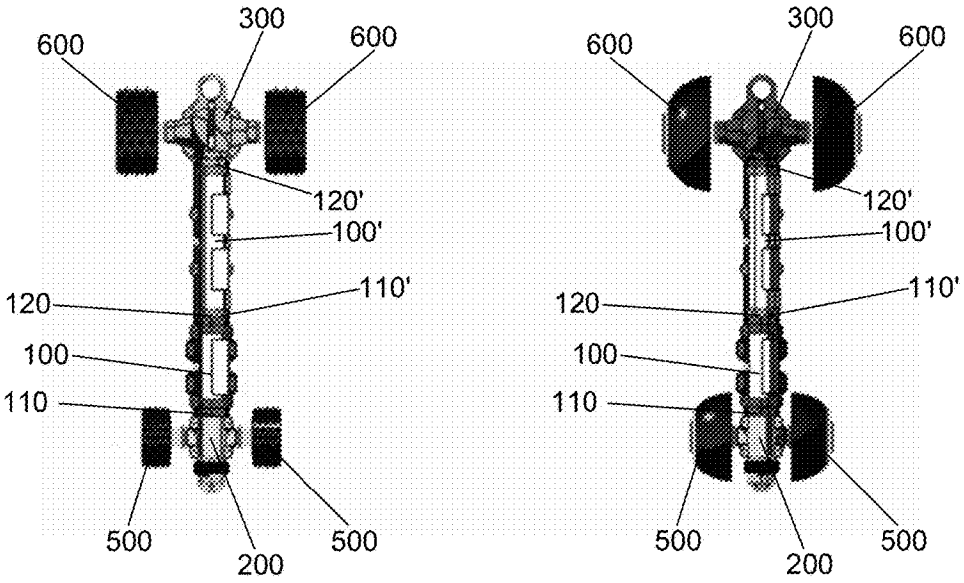
FIG. 8 illustrates a top view of modular toy vehicles in accordance with an embodiment of the present invention where the modular toy vehicle includes a first main body module and a second main body module.

As illustrated in FIG. 8, a user may also construct the modular toy vehicle 100 by coupling the first main body module 100 and the second main body module 100' to one another before coupling the steering module 200 and the gearbox module 300 to the first and second main body modules 100, 100'. FIG. 8 illustrates that the second end 120 of the first main body module 100 is coupled to the first end 110' of the second main body module 100'. The steering module 200, with two front wheels 500, is coupled to the first end 110 of the first main body module 100, while the gearbox module 300, with two rear wheels 600, is coupled to the second end 120' of the second main body module 100'.

Combining the first and second main body modules 100, 100' enables elastic members 170 to be placed within both of the main body modules 100, 100'. This enables a modular toy vehicle 10 that includes both the first and second main body modules 100, 100' to build up more potential energy when winding the elastic members 170. Thus, a modular toy vehicle 10 including both the first and second main body modules 100, 100' may be faster and/or able to travel a farther distance than a modular toy vehicle 10 with only one of the first or second main body modules 100, 100'.

FIG. 8 also illustrates that different types of wheels may be coupled to the modular toy vehicle 10. The modular toy vehicle 10 on the left side of FIG. 8 includes front wheels 500 and rear wheels 600 which are knobby, similar to the wheels illustrated in FIGS. 1-2. The modular toy vehicle 10 on the right side of FIG. 8, however, includes front wheels 500 and rear wheels 600 that are smoother than those illustrated on the modular toy vehicle 10 on the left side of FIG. 8, which is similar to the wheels illustrated in FIGS. 3 and 4. The type of wheel 500, 600 that may be coupled to the modular toy vehicle 10 may depend on what type of terrain the modular toy vehicle 10 will travel across. The user may also choose the type of wheel 500, 600 that is coupled to the modular toy vehicle 10 based on the speed in which the user wishes the modular toy vehicle 10 to travel across the support surface (i.e., the smoother wheels 500, 600 may enable the modular toy vehicle 10 to travel faster across a support surface than knobby wheels 500, 600).

Figure 9:
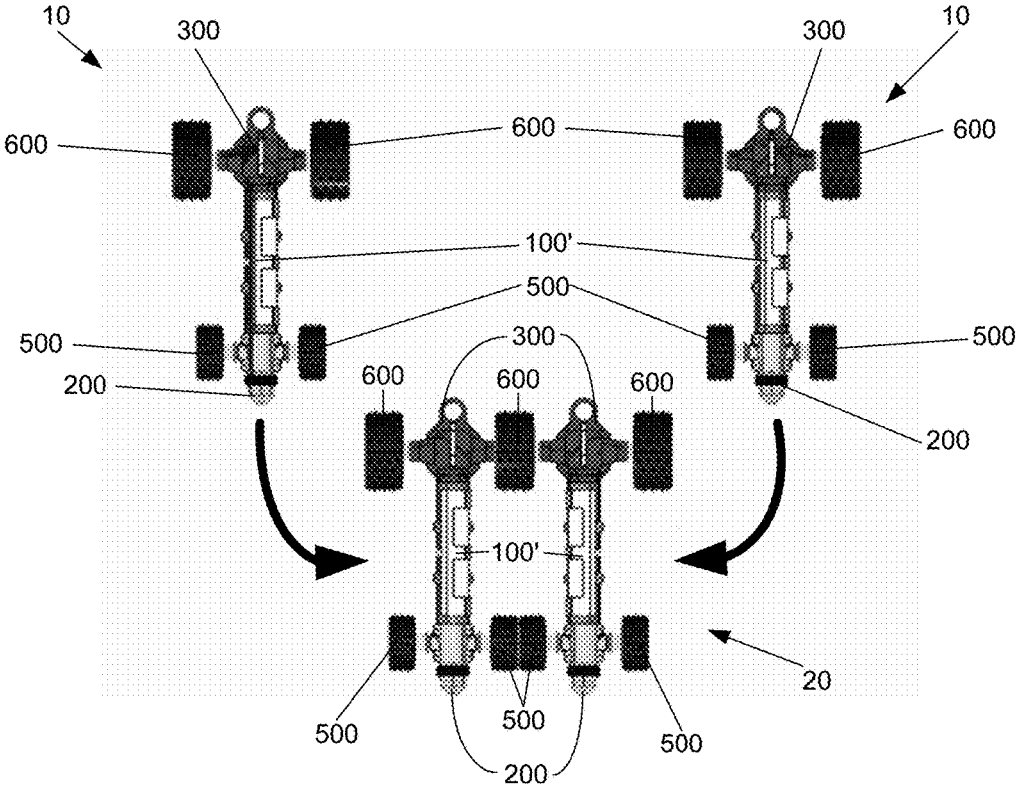
FIG. 9 illustrates a top view of the combination of two modular toy vehicles into a single combined modular toy vehicle in accordance with an embodiment of the present invention.

Turing to FIG. 9, illustrated is the combining of two modular toy vehicles 10, 10' into a single combined modular toy vehicle 20. The two modular toy vehicles 10 are each constructed from the same combination of modules, which include the second main body module 100', the steering module 200, and the gearbox module 300. As illustrated, the two modular toy vehicles 10 may be combined together to form a singular combined modular toy vehicle 20 that includes two main body modules 100', two steering modules 200, and two gearbox modules 300. Furthermore, the combined modular toy vehicle 20 includes four front wheels 500 and three rear wheels 600. As illustrated two of the front wheels 500 may be coupled to one another such that they are still configured to rotate with respect to the steering modules 200. In addition, one of the rear wheels 600 may be removed, such that one rear wheel is rotatably coupled to both gearbox modules 300. Because the combined modular toy vehicle 20 includes two modules 100', the combined modular toy vehicle 20 may travel twice the distance and/or twice as fast as a modular toy vehicle 10 equipped with the same main body module 100'.

Figure 10:
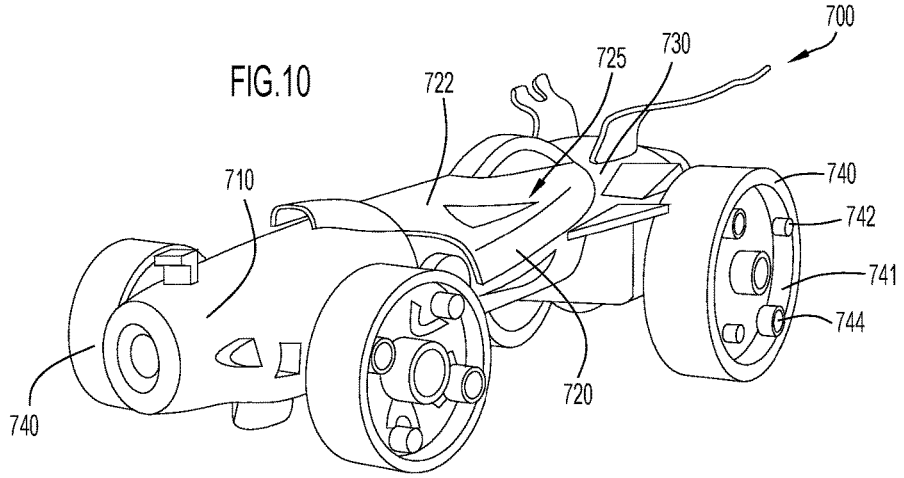
FIG. 10 illustrates a front perspective view of a toy vehicle in accordance with another embodiment of the present invention.
Figure 11:
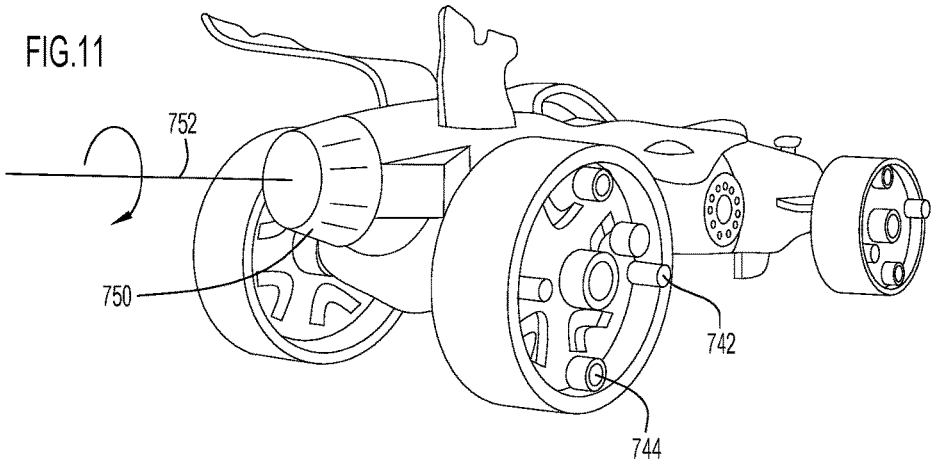
FIG. 11 illustrates a rear perspective view of the toy vehicle in FIG. 10.
Figure 12:
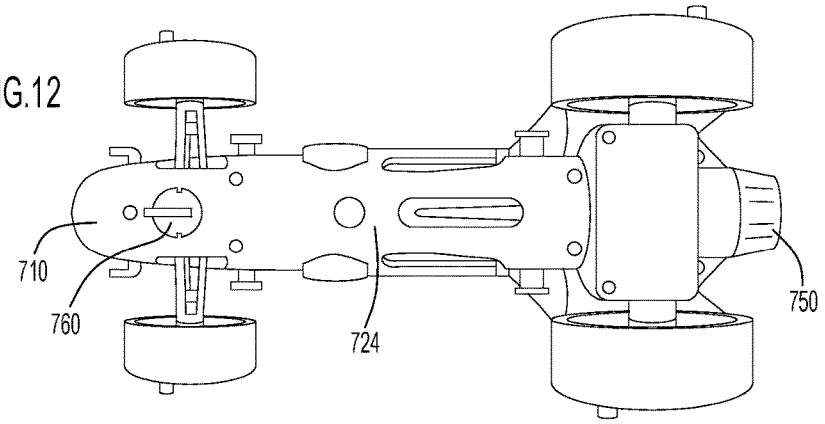
FIG. 12 illustrates a bottom view of the toy vehicle in FIG. 10.

Referring to FIGS. 10-12, another embodiment of a toy vehicle according to the present invention is illustrated. In this embodiment, toy vehicle 700 includes a front section 710, a body or power section 720, and a rear or drive section 730. The body section 720 is releasably coupled to both of the front section 710 and the rear section 730. Toy vehicle 700 includes four wheels as illustrated.

The body section 720 includes a pivotally mounted cover 722 that can be moved from a closed position to an opened position relative to the body section 720. The body section 720 defines an interior region or chamber 725 that contains an elastic member that is wound to store energy. Referring to FIG. 11, a knob or actuator 750 is rotatably mounted to the rear section 730 of the toy vehicle 700. A user can rotate the actuator 750 along the direction of the arrow about rotation axis 752 to wind the elastic member or members in chamber 725. When released, the elastic member or members causes a rear axle to which the rear wheels are coupled to rotate, thereby rotating the wheels and moving the toy vehicle.

As shown, several wheels 740 are rotatably coupled to the front section 710 and to the rear section 730. Each of the wheels 740 includes a body 741 that has a pair of extensions or posts 742 extending outwardly therefrom and a pair of openings or apertures 744 formed therein. Each opening 744 is sized so that one of the extensions 742 on a wheel of a different toy vehicle can be engaged with the opening 744. Thus, two or more toy vehicles can be placed side-by-side into engagement with adjacent toy vehicles. As a result, the power stored in the elastic members in the toy vehicles can be used collectively to move the toy vehicles along a surface. In other embodiments, the body of each wheel may include one extension and one opening, or other quantities of extensions and openings.

Referring to FIG. 12, the body section 720 has a lower surface 724 and the front section 710 includes a steering mechanism 760 that is rotatably coupled to the lower surface of the toy vehicle. A user can turn or rotate the steering mechanism 760 like a dial and adjust the orientation of the front wheels relative to the front section 710 to cause the toy vehicle to turn in a desired direction.

Referring to FIGS. 13-16, another embodiment of a toy vehicle according to the present invention is illustrated. In this embodiment, toy vehicle 800 includes a front section 810, a body section 820, and a rear section 830. The body section 820 defines an interior chamber 825 and has a cover 822 pivotally mounted thereto that can be moved to allow access to the chamber 825. Toy vehicle 800 includes a front wheel 840 and a rear wheel 842 that is larger than the front wheel 840. In another embodiment, the wheels 840 and 842 can be the same size.

Toy vehicle 800 includes an actuator 850 that can be rotated to wind one or more elastic members located in the chamber 825. The actuator 850 is located on the rear section 830, which also includes a release button 852 that can be pressed to release the elastic members to drive the toy vehicle 800.

Due to the size limitations of toy vehicle 800, a gear or drive mechanism 860 is mounted on one side of the toy vehicle 800 can coupled thereto via connectors 862. The gear mechanism 860 includes multiple gears (including gear 864) that collectively form a gear train that operably connects the output of the elastic member or members to the axle of the rear wheel 842 to drive the rear wheel 842. Once the elastic member(s) are wound, the button 852 can be pressed to cause the rear axle to rotate.

Figure 17:
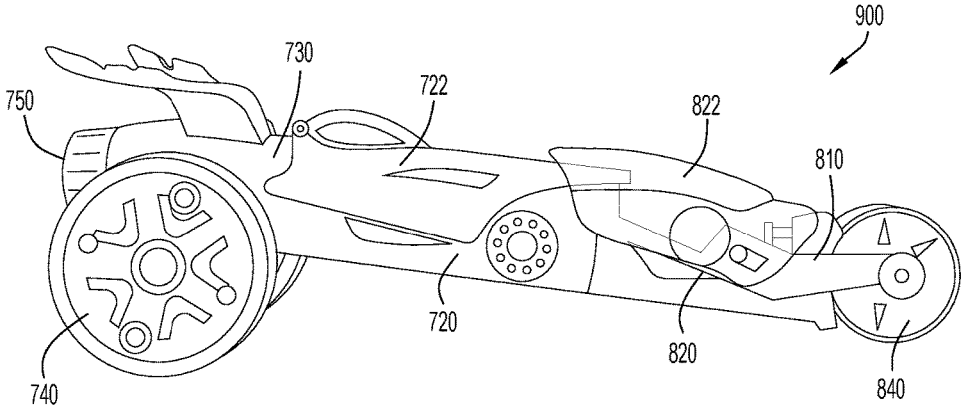
FIG. 17 illustrates a side view of an embodiment of a toy vehicle including components from the toy vehicles in FIG. 10 and in FIG. 13.
Figure 18:
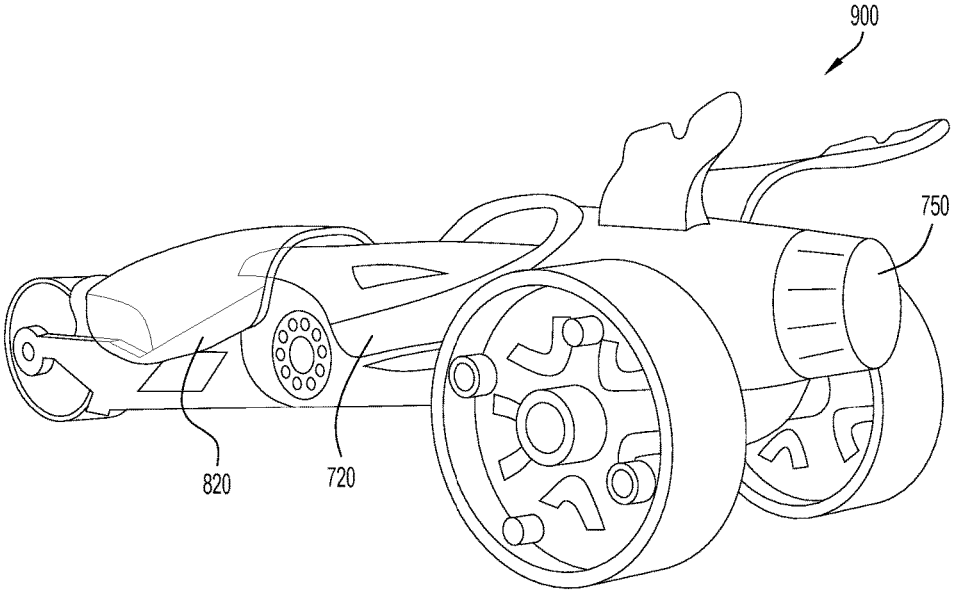
FIG. 18 illustrates a rear perspective view of the toy vehicle in FIG. 17.

Referring to FIGS. 17-18, a toy vehicle 900 that combines various components of toy vehicles 700 and 800 is illustrated. In this embodiment, toy vehicle 900 includes body portion 820 and front portion 810 from toy vehicle 800. As shown, cover 822 and front wheel 810 are also included. In addition, toy vehicle 900 includes body section 720 and rear section 730 from toy vehicle 700, with cover 722 and rear wheels 740. The actuator 750 can be rotated by a user to wind the elastic member(s) in chamber 725 and the elastic member(s) in chamber 825. The modular configuration of toy vehicle 900 enables the vehicle to utilize the stored energy of body section 720 and body section 820, collectively, to power toy vehicle 900.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration.

Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A modular toy vehicle comprising:

a first body portion having a first end and a second end, and defining a first chamber between the first end and the second end of the first body portion, the first body portion including a first elastic member in the first chamber;

a second body portion having a first end and a second end, and defining a second chamber between the first end and the second end of the second body portion, the second body portion including a second elastic member in the second chamber, the first end of the second body portion being releasably coupled to the second end of the first body portion to orient the first chamber and the second chamber in series, and releasably couple the first elastic member and the second elastic member in series;

a front portion coupled to the first end of the first body portion, the front portion including at least one wheel coupled thereto; and a rear portion coupled to the second end of the second body portion, the rear portion including at least one wheel coupled thereto, the rear portion including an actuator operably connected to the first elastic member disposed within the first chamber and the second elastic member disposed within the second chamber and configured to wind the first and second elastic members to store energy, wherein the energy stored in the elastic members drives the toy vehicle along a support surface when released.

2. The modular toy vehicle of claim 1, wherein the first body portion is of a first length and the second body portion is of a second length, the second length being greater than the first length.

3. The modular toy vehicle of claim 1, wherein the actuator is configured to rotate about a longitudinal axis of the modular toy vehicle to wind the first and second elastic members.

4. The modular toy vehicle of claim 3, wherein the actuator of the rear portion is a first actuator, the rear portion further comprising:

a second actuator, wherein depressing of the second actuator after the first and second elastic members have been wound releases the energy stored in the first and second elastic members.

5. The modular toy vehicle of claim 1, wherein front portion further comprises:

a steering mechanism configured to adjust an orientation of the at least one wheel of the front portion relative to the front portion to cause the modular toy vehicle to turn in a desired direction.

6. The modular toy vehicle of claim 1, wherein the front portion is releasably coupled to the first end of the first body portion and the rear portion is releasably coupled to the second end of the second body portion.

7. A modular toy vehicle comprising:

a body portion having a first end and a second end, the body portion defining a chamber that comprises:

a first connector fixed within the chamber proximate to the first end of the body portion, a second connector rotatably disposed within the chamber proximate the second end of the body portion, and one or more elastic members disposed within the chamber and coupled to the first connector and the second connector; and a drive portion removably coupled to the second end of the body portion, the drive portion including at least one wheel coupled thereto, the drive portion including an actuator removably and operably-connected to the second connector within the chamber and configured to rotate the second connector to wind the one or more elastic members to store energy, wherein the stored energy in the one or more elastic members drives the at least one wheel coupled to the drive portion to propel the toy vehicle along a surface when released.

8. The modular toy vehicle of claim 7, wherein the drive portion further includes:

a drive axle removably and operatively coupled to the second connector and the at least one wheel of the drive portion.

9. The modular toy vehicle of claim 8, wherein the actuator is configured to rotate about a longitudinal axis of the modular toy vehicle in a first direction to rotate the second connector about the longitudinal axis in a first direction to wind the one or more elastic members.

10. The modular toy vehicle of claim 9, wherein the actuator of the drive portion is a first actuator, the drive portion further comprising:

a second actuator, wherein depression of the second actuator after the one or more elastic members have been wound releases the energy stored in the one or more elastic members to cause the one or more elastic members to unwind and rotate the second connector about the longitudinal axis in a second direction.

11. The modular toy vehicle of claim 10, wherein rotation of the second connector about the longitudinal axis in the second direction causes the drive axle and the at least one wheel of the drive portion to propel the modular toy vehicle.

12. The modular toy vehicle of claim 7, wherein the second end of the body portion includes at least one protuberance, and the drive portion includes at least one slot, the at least one slot of the drive portion being configured to receive the at least one protuberance of the second end of the body portion to removably secure the drive portion to the second end of the body portion.

13. The modular toy vehicle of claim 7, wherein the drive portion is removably coupled to the second end of the body portion via a friction fit.

14. The modular toy vehicle of claim 7, wherein the first connector and the second connector are hooks.

15. A modular toy vehicle comprising:

a front portion;

at least one first wheel removably coupled to the front portion;

a body portion having a first end and a second end, the first end being removably coupled to the front portion, the body portion defining a chamber spanning from the first end to the second end, body portion further comprising:

a first connector fixed within the chamber proximate to the first end;

a second connector rotatably disposed within the chamber proximate to the second end; and one or more elastic members disposed within the chamber and coupled to the first connector and the second connector;

a rear portion removably coupled to the second end of the body portion, the rear portion including an actuator that is removably and operably connected to the second connector and configured to rotate the second connector to wind the one or more elastic members to store energy when the rear portion is removably coupled to the second end of the body portion, at least one second wheel removably coupled to the rear portion, wherein the stored energy in the one or more elastic members drives the at least one second wheel to propel the toy vehicle along a support surface when released.

16. The modular toy vehicle of claim 15, wherein the at least one first wheel is smaller in diameter than the at least one second wheel.

17. The modular toy vehicle of claim 15, wherein the at least one second wheel includes a body with at least one post extending outwardly therefrom and at least one opening formed therein.

18. The modular toy vehicle of claim 17, wherein the at least one opening is sized to receive at least one post of a third wheel of a second modular toy vehicle while the at least one post of the at least one second wheel is sized to be received by at least one opening of the third wheel of the second modular toy vehicle to couple the second modular toy vehicle to the modular toy vehicle in a side-by-side orientation.

19. The modular toy vehicle of claim 15, further comprising at least one third wheel removably coupled to the rear portion when the at least one second wheel is uncoupled from the rear portion.

20. The modular toy vehicle of claim 19, wherein the at least one second wheel includes a smooth outer surface and the at least one third wheel includes a knobby outer surface.

* * * * *